United States Patent [19]

Boyce et al.

[11] Patent Number: 4,743,324

[45] Date of Patent: May 10, 1988

[54] PRINTING PLATE MOUNTER

[75] Inventors: Donald R. Boyce, Simpsonville; Thomas O'Neal Harrelson, Fountain Inn; Tony R. Phillips, Easley, all of S.C.

[73] Assignee: W. R. Grace & Co., Cryovac Div., Duncan, S.C.

[21] Appl. No.: 898,291

[22] Filed: Aug. 20, 1986

[51] Int. Cl.[4] ..... B41L 29/12

[52] U.S. Cl. ..... 156/215; 156/447; 156/457; 33/621; 101/DIG. 12

[58] Field of Search ..... 101/375, 378, DIG. 12, 101/415.1; 33/617–621; 156/184, 215, 446, 447, 457, 458

[56] References Cited

U.S. PATENT DOCUMENTS

| | | | |
|---|---|---|---|
| 3,550,283 | 12/1970 | Bernardi et al. | 101/378 X |
| 3,567,558 | 3/1971 | Gemperle | 156/555 |
| 4,004,509 | 1/1977 | Moss . | |
| 4,019,434 | 4/1977 | Hoexter . | |
| 4,033,259 | 7/1977 | Schuhmann . | |
| 4,380,956 | 4/1983 | Elworthy . | |
| 4,437,403 | 3/1984 | Greiner . | |
| 4,446,625 | 5/1984 | Hagan et al. . | |
| 4,484,522 | 11/1984 | Simeth . | |
| 4,520,389 | 5/1985 | Hornschuh | 33/617 X |

OTHER PUBLICATIONS

Production Cost Saver, an article appearing in Paper, Film & Foil Converter, Sep. 1987, pp. 63–64.

*Primary Examiner*—Clifford D. Crowder
*Attorney, Agent, or Firm*—John J. Toney; William D. Lee, Jr.; Mark B. Quatt

[57] ABSTRACT

An apparatus for mounting a flexible printing plate on a printing cylinder comprises a table comprising a planar surface and two separable sections, whereby the sections when separated can accommodate therebetween an upper surface of the printing cylinder. The printing plate is aligned on the table in order to accurately mount the printing plate on the cylinder. The table is then separated and the cylinder moved into contact with the plate which is then adhered thereto as the cylinder is rotated.

19 Claims, 11 Drawing Sheets

PRINTING PLATE MOUNTER

The present invention relates to the reproduction of art work on flexible plastic packaging materials, and more specifically to a method and apparatus for the quick, accurate mounting of a photopolymer printing plate on a printing cylinder.

BACKGROUND OF THE INVENTION

The growth in the use of flexible plastic packaging, especially for food items, has resulted in an increasing need for suitable labeling of the packaged products to identify the manufacturer, contents of the package, and the like. Some of this information may be required by regulatory agencies. The product manufacturer or food processor has also found it desirable for marketing reasons to provide increasingly sophisticated labeling on a package to include, for example, graphic trademarks and other information. If presented in an attractive way, such labeling can contribute to increased sales.

Because of the deficiencies in attaching discrete, preprinted labels to flexible thermoplastic packaging material, it is typical for the package producer or intermediate processor to print suitable labels on the packaging material. Commonly, rubber printing plates are used to reproduce art work, for example, art work supplied by the customer, onto the film, laminate, or bag. These rubber printing plates are used in a flexographic process well known in the art by utilizing the raised plate on a roller in combination with a fountain roller and an intermediate knurled cylinder for ink transfer to the rubber plate.

In fabricating such rubber plates, art work is prepared and then photographic negatives are made from the prepared art work. A zinc metal master is then engraved from the photographic negatives. The metal master may then be used to mold a phenolic matte from which a rubber plate may be molded.

More recently, it has been found advantageous to use photopolymer printing plates in lieu of rubber printing plates. The photopolymer plates may be made directly from the photographic negatives, without the need for engraving a zinc metal master or molding a phenolic matte. In the photopolymer plate making process, the prepared art work is photographed and the resulting negative is placed over a polymeric sheet that contains a light sensitive agent. When this polymeric sheet is exposed to ultraviolet light, a cross-linkable composition of the sheet causes the exposed areas to become insoluble, providing a negative image or raised relief of the design when solvent washed or developed.

Photopolymer plates offer many advantages including better print quality, better plate thickness uniformity, less shrinkage and stretch differential when the plate is mounted and removed from a repeat cylinder (i.e. dimensional stability) and improved clarity and consistency of the photopolymer in the case of plate remakes. The dimensional stability of the photopolymer plates is particularly important in successful process printing to achieve good registration between colors.

Finally, photopolymer plates produce cost savings by the reduction of mounting time on print cylinders, and reduce material cost.

Despite the advantages of photopolymer plates, it has still been the common practice in the art to premount printing plates, whether rubber plate or photopolymer plate. The premounting process involves the positioning of printing plates upon print cylinders utilized on the printing press. The premounting process is a time consuming effort in that typically one cylinder is used for each color in the label to be printed, and the number of plates mounted on each cylinder reflects the number of labels to be printed both across and around the circumference of the cylinder.

In current practice, the operator is required to manually rotate each printing cylinder and place the plate according to an image reflected in a mirror located behind the cylinder. This image originates from a proofing cylinder located near the printing cylinder, and containing either proofs of the label to be mounted, or horizontal and vertical center lines marked on paper. When a plate or a series of plates has been positioned on the printing cylinder, the plates are inked and a proof is taken on the proofing sheet secured to the proofing cylinder. For multi-color orders, a printing plate or series of printing plates for the next color is mounted on a new printing cylinder. Repeating the method described above, the new plate or series of plates is positioned on the new cylinder using the mirror image of the layout on the proofing cylinder, and the plates are inked and the image is superimposed on the proofing sheet of the proofing cylinder. This procedure is repeated for as many colors as will appear in the final label. In this way, the proofing sheet will eventually have each color of the label printed in register. In practice, precise location of the plate is difficult to achieve through this manual process, and improper mounting of a plate may result in idle production time while the plate is remounted or readjusted. Remounting of plates adhered to a printing cylinder with adhesive tape can be especially difficult. U.S. Pat. No. 4,380,956 describes the disadvantages associated with conventional mounting/proofing techniques.

Clearly, an improved method and apparatus is desirable to substantially reduce both the time required for mounting of the particular order, including each color for a particular label and the number of plates to be mounted on each color printing cylinder, as well as the accuracy in mounting the photopolymer plates.

Various methods and different types of apparatus have been proposed to avoid or mitigate the shortcomings of the common procedure for proofing printing plates. One such example is U.S. Pat. No. 4,004,509 issued to Moss, in which various diameters of plate cylinders are accommodated by providing a proofing cylinder which may be transferred from a forward position proofing state to a rear position mounting state. This is accomplished by cantilevering the proofing cylinder on the free end of a swing arm.

U.S. Pat. No. 4,019,434 issued to Hoexter likewise discloses a mounting-proofing machine for proofing printing plates, in which a plate cylinder is moveable relatively to the impression or proof cylinder, with gearing designed to adjust the phase relationship for different plate cylinder diameters, while permitting the use of a viewer to align printing plates on a plate cylinder according to an image reflected from the proof sheet on an impression cylinder.

Of interest is U.S. Pat. No. 4,380,956 issued to Elworthy, in which still another alternative to the conventional mounting proofing method is described as the use of registration holes in the printing plates, and passing registered pins through the registration holes, and those of a carrier sheet.

Of interest is U.S. Pat. No. 4,437,403 issued to Greiner, which discloses an automatic control system for controlling automatic means for adjusting plate cylinders in response to register control signals. Relative and reference positions may be stored, and a microprocessor is used to accept individual numerical values derived from a line scan camera and converter to digital values.

Of interest is U.S. Pat. No. 4,446,625 issued to Hagan, which discloses an apparatus for mounting photopolymeric printing plates on a printing cylinder, the apparatus including a frame and fixing means for affixing the plate to the frame by keys. The printing plate may be positioned axially of an tangentially to a printing cylinder on which the plate is to be mounted.

Of interest is U.S. Pat. No. 4,484,522 issued to Simeth, which discloses the use of register marks placed at any desired position on printing plates, optical scanners traversably mounted for axial movement with respect to plate cylinders, and a computer for remote control of register adjusting devices.

It is an object of the present invention to provide an apparatus and method for mounting a photopolymer printing plate, or a series of printing plates, on a printing cylinder in an efficient and accurate manner.

It is a further object of the present invention to provide an apparatus and method for mounting a photopolymer printing plate, or a series of printing plates, on a printing cylinder, which apparatus and method reduces the time typically required to mount a printing plate.

It is a further object of the present invention to provide an apparatus and a method for mounting a photopolymer printing plate, or a series of photopolymer printing plates, on a printing cylinder, which apparatus and method reduces the need for readjusting printing plates already mounted on a printing cylinder because of inaccuracies in mounting position.

SUMMARY OF THE INVENTION

In accordance with the present invention, an apparatus for mounting a flexible printing plate on a printing cylinder comprises a table comprising a planar surface and two separable sections, whereby the sections when separated can accommodate therebetween an upper surface of the printing cylinder; means for aligning the position of the printing plate on the table in order to accurately mount the printing plate on the cylinder; and means for adhering the printing plate to the printing cylinder.

In another aspect of the present invention, a method of mounting a flexible printing plate on a printing cylinder comprises placing a printing plate on a table having a planar surface and two separable sections; aligning the position of the plate to match predetermined coordinates; separating the sections of the table; placing the printing cylinder between the separated sections; and transferring the plate from the table to the cylinder.

BRIEF DESCRIPTION OF THE DRAWINGS

Further details are given below with reference to the drawings wherein.

DESCRIPTION OF THE PREFERRED EMBODIMENTS

Figure 1:
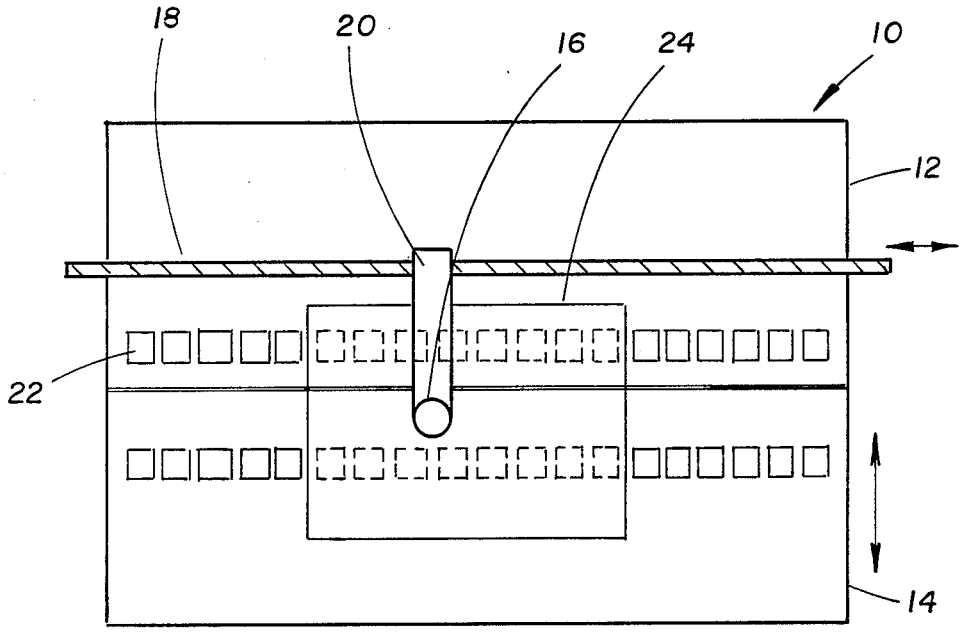
FIG. 1 is a schematic plan view of a plate mounter in accordance with the present invention.

Referring specifically to the drawings, in FIG. 1 a plate mounter is shown in the schematic plan view. A table 10 is used to mount a printing plate 24 on a printing cylinder 26 with high accuracy and repeatability. Typically, a printing plate 24 will be used for one color on a given printing cylinder, so that the number of cylinders 26 to be prepared for a particular job or order will equal the number of colors to be included in the final printed label. As described herein, the apparatus and the method is directed to the placement of one printing plate on a printing cylinder, as well as several plates placed or mounted across and around a cylinder, and the number of plates is variable depending on the specific label design, cylinder size, plate size, and the like.

In the preferred embodiment, plate mounting for each color printing cylinder is accomplished by using a suitable microprocessor-based motion controller. Cylinder and plate data, particularly dimensional data and spacing data, are entered by the equipment operator. The microprocessor makes appropriate calculations based on the data put into the system, and downloads motions necessary to drive a microscope and the cylinder to register points such that a plate can be properly aligned under the microscope cross hairs.

Although the description of the preferred embodiment herein is directed to microprocessor-based motion control, it should be understood that manual operation and calculation, although considerably more tedious, may also be used to accomplish accurate placement of printing plates on printing cylinders using the apparatus.

Figure 5:
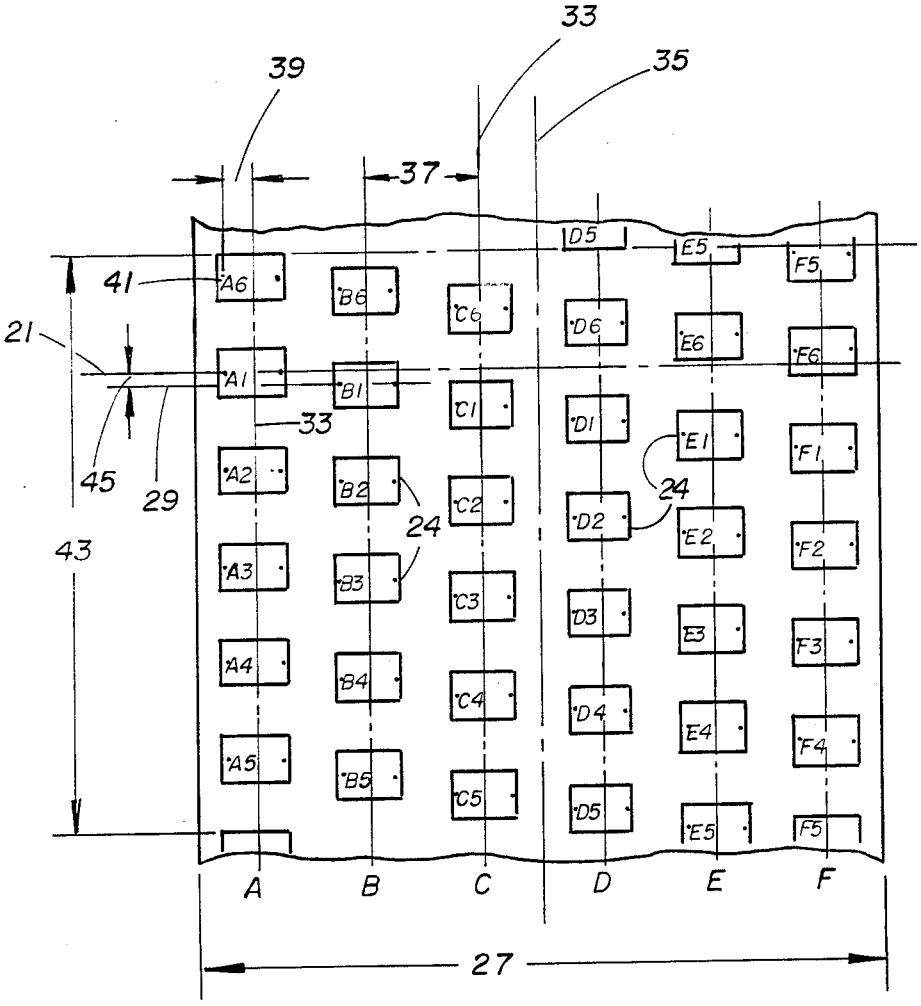
FIG. 5 is an offset plate layout in accordance with the present invention.

As mentioned, the number of plates to be mounted across and around a cylinder may vary, with transverse dimensions specified from the center line 35 of the cylinder face width 27 (FIG. 5). Vertical dimensions, i.e. dimensions around the circumference of the cylinder, are specified from the number of plates around beginning at a register scribe line 21 (FIG. 5) which runs across the length of the cylinder.

Plates 24 are individually mounted through successive calculations and motion control.

The table 10 has a first separable section 12 and a second separable section 14. An overhead microscope 16 with cross hairs in the field of view is connected to a drive means 18 by means of a scope support 20. The microscope is horizontally driven by a 0.200 inch per revolution preloaded ball screw to an accuracy of 0.0001 plus or minus 0.00005 inches and a repeatability of 0.0001 inches. The microscope can travel at a horizontal speed of 2 inches per second linear travel, corresponding to 600 revolutions per minute motor speed. The horizontal load force is 3.6 pounds, equal to 0.2 coefficient of friction multiplied by the microscope weight of 18 pounds.

The microscope drive means 18, therefore, comprises appropriate motor controls, a motor 64, and a support 20 and guide shafts 66 for microscope 16 which permits the microscope to move in a horizontal plane substantially in alignment with the longitudinal axis of the table 10 and printing cylinder 26.

This invention is particularly advantageous in providing very accurate placement of printing plates on a printing cylinder. A plate 24, depicted in FIG. 1 of the drawings, is placed on the mounting table 10 and aligned under the cross hairs of the microscope 16 according to predetermined parameters. The microscope is "homed" at a point 25 typically at the left hand side of the table and in alignment with the left hand edge of the printing cylinder 26 on which the printing plate 24 is to be mounted. By manual calculation or preferably by the use of microprocessor calculation, with appropriate input from the microprocessor to the various drive means to be described below, the printing plate 24 may be accurately and precisely placed on the table 10 for subsequent precise placement on printing cylinder 26. Although the plate could be manually held or otherwise manually clipped to the moving table prior to actual placement on the printing cylinder 26, it is more preferable to hold the plate 24 to the table 16 by means of vacuum ports 22 located in the first and second table sections 12 and 14 respectively. Even more preferably, these vacuum ports are disposed along the width of the table in opposing pairs, as pictured in FIG. 1. In operation, after the plate 24 has been precisely placed on table 10 by means of the overhead microscope 16, the vacuum ports 22 can be activated to temporarily affix the plate 24 to its particular location on the table 10. The vacuum ports 22 remain activated while the respective table sections 12 and 14 are separated, preferably by manually sliding the second table section 14 toward the operator. The vacuum ports are operated with a differential of vacuum between the set of vacuum ports 22 on table section 12 and the set of vacuum ports 22 on table section 14. By pulling a higher vacuum on the first table section 12, the printing plate 24 will still be adhered to the table surface while the table sections 12 and 14 are separated. Separation of table sections 12 and 14 causes the printing cylinder 26 to rise and contact the lower surface of the printing plate 24. The table section 14 lowers, easily allowing the front edge of the printing plate i.e. the part of the printing plate closest to the operator to be manually smoothed down onto the printing cylinder 26. The cylinder 26 is then rotated, causing the vacuum ports 22 to deactivate, and permitting the remainder of the printing plate 24 to be placed on the printing cylinder 26 as the cylinder is rotated about its axis, preferably by cylinder rotation drive means 30 (See FIGS. 2 and 3).

Preferably, the cylinder is rotated by a drive means 30 to an accuracy of 0.0001 inches plus or minus 0.00005 inches with a repeatability, on a cylinder circumference of 36 inches in repeat length, of 0.0001 inches. This is equivalent to 3.6 plus or minus 1.8 arc seconds and 3.6 arc seconds respectively. These represent preferred maximum allowable tolerances to ensure the accuracy and repeatability of the system.

Figure 2:
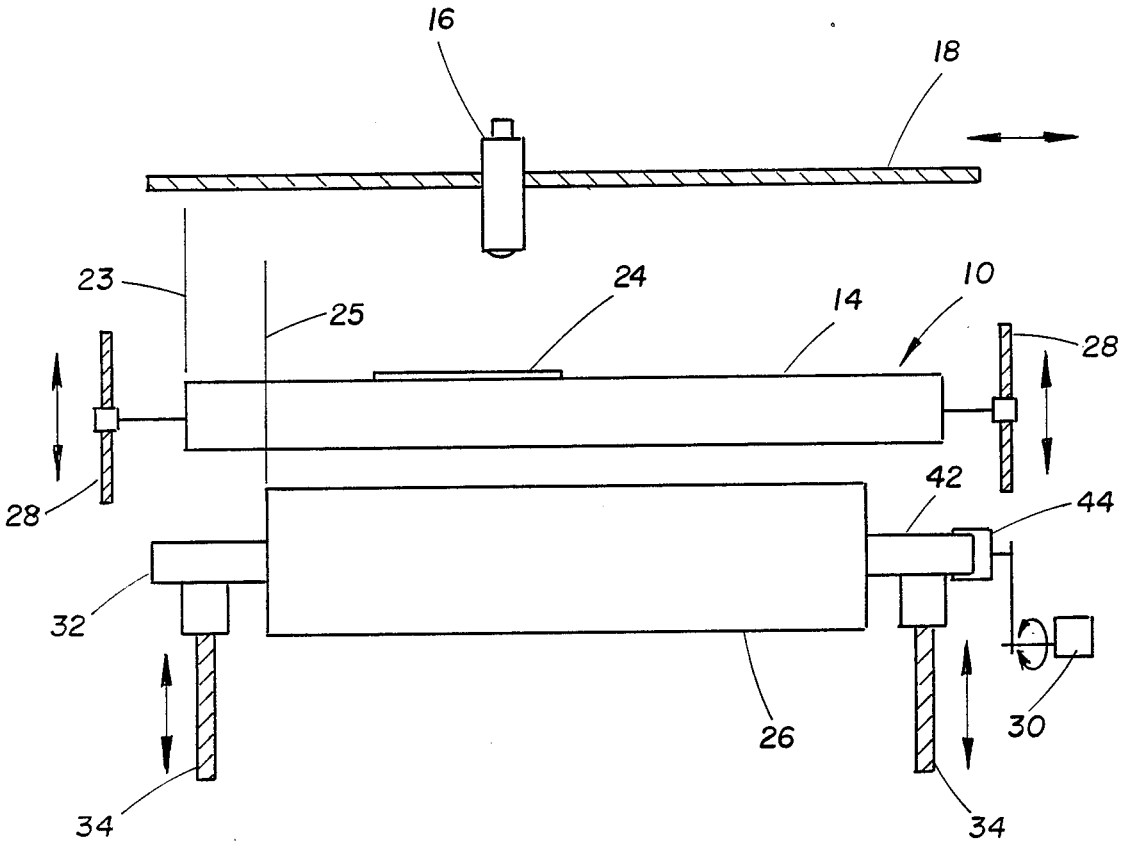
FIG. 2 is a schematic front view of a plate mounter in accordance with the present invention.
Figure 3:
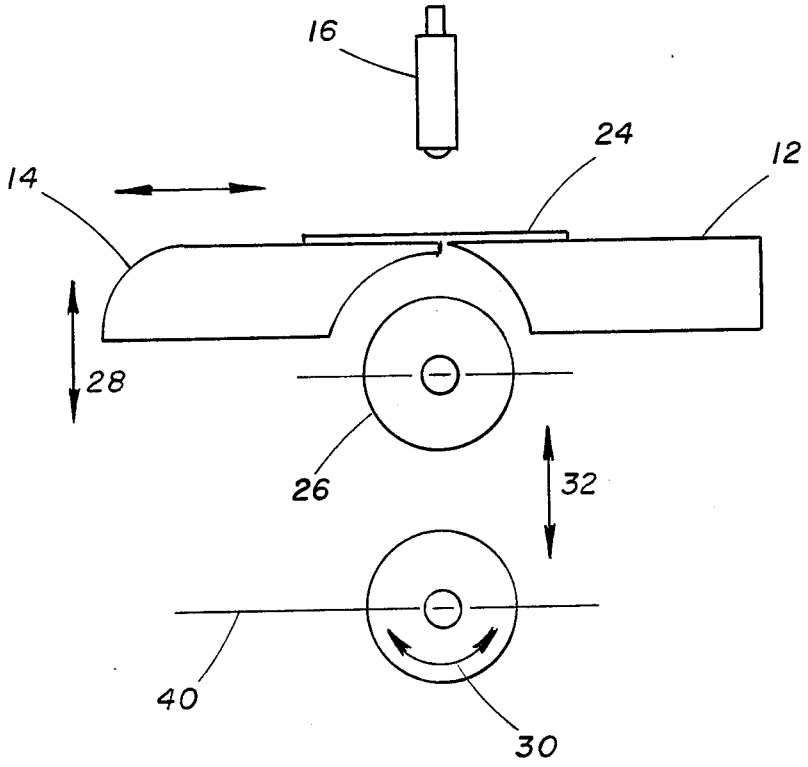
FIG. 3 is a schematic side view of a plate mounter in accordance with the present invention.

Tolerances horizontally, i.e. along the cylinder 26 are referenced to the microscope "home" setting as depicted by line 25 in FIG. 2. The vertical reference is the horizontal register scribe line 21 illustrated in FIG. 5. In accordance with the present invention, errors in placement of more than one printing plate will not be cumulative, thus allowing errors from corner to corner on a plate layout to be kept preferably within 0.0001 inches. The cylinder rotation drive means 30 depicted schematically in FIG. 2 and FIG. 3 by a curved double arrow, includes a motor and a zero-backlash gear box to provide a cylinder rotation speed of about 2 revolutions per minute with a load inertia of preferably about 19 in. lb. sec. $^2$ on the largest cylinder. A suitable gear box is that available under the trade designation Harmonic Drive.

Figure 4:
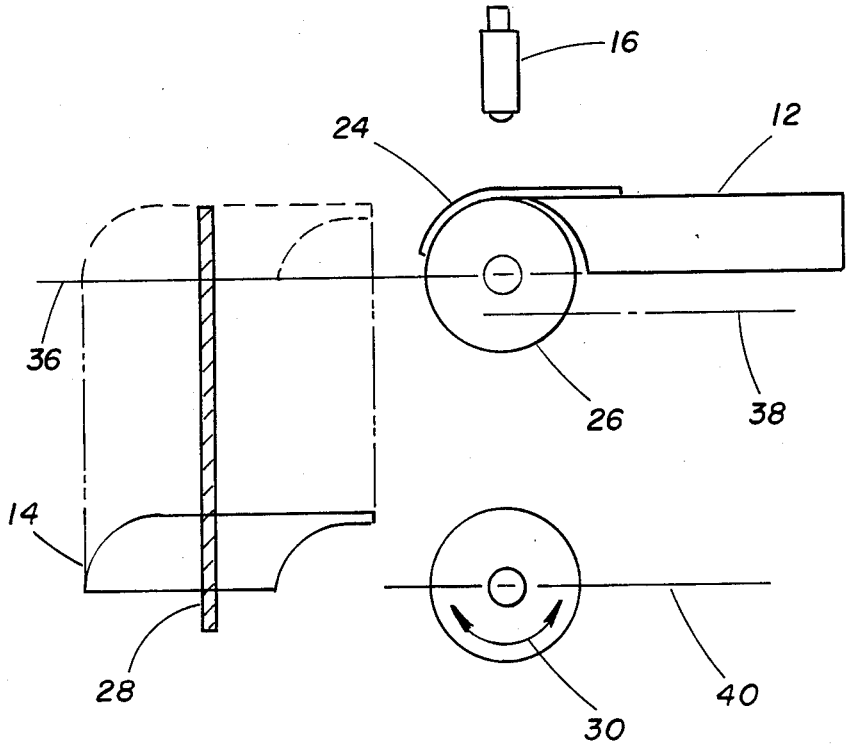
FIG. 4 is another schematic side view of a plate mounter showing mounting of a label in accordance with the present invention.

The table 10 separates, preferably by manually sliding out second table section 14 (see FIGS. 3 and 4) to permit the leading edge of the aligned and affixed plate to be laid on the printing cylinder 26 which has adhering means for holding the plate to the cylinder. Preferably, the cylinder is prewrapped with double sticky back adhesive. As best seen in FIG. 4, section 14 of table 10 can be raised and lowered by a pair of drive means 28, one on either side of the table section 14 (see FIG. 2). Section 14 of table 10 can be driven vertically by a motor and a set of ball screws, the table moving vertically by 0.200 inches per revolution. The load force for each drive means 28 is preferably about 300 pounds, correlated to a ball screw motor torque of 25 inch pounds including a 25% safety factor. A suitable lift speed is about 2 inches per second over 15 inches of vertical travel requiring a motor speed of about 600 revolutions per minute.

To insure that table section 14 does not move toward the first table section 12, or raised printing cylinder 26, during its descent, a set of cam followers (not shown) is provided. These followers or rollers are positioned in relation to a sheet of metal such that section 14 can be raised or lowered in a true vertical direction.

Counter balance air cylinders (not shown) can optionally be included to help support table 10. In the event of a fault condition, the weight of table 10 may overcome the friction of the ball screws of drive means 28. In this case, the air cylinders would provide support to table 10.

A cylinder carriage 32 which bears and supports cylinder 26 may be moved vertically by a pair of cylinder carriage drive means 34 (FIG. 2). As in the case of drive means 28 of section 14 of table 10, the drive means 34 for the cylinder carriage are located on either side of the cylinder 26. A motor/ball screw combination with a preferable lift speed of about 0.5 inches per second over 6 inches of travel can be used. Using 0.200 inches per revolution ball screws, the motor speed is about 150 revolutions per minute. Drive means 34, like drive means 28, preferably includes counter balance air cylinders for support.

In the preferred embodiment therefore, a printing cylinder 26 with a double sticky back adhesive applied to the surface of the cylinder is introduced beneath a mounting table 10 having two coplanar separable sections 12 and 14. A printing plate 24 is placed on the table 10 and aligned using overhead microscope 16 to locate the plate 24 at a reference position using predetermined coordinates. Vacuum ports in a first table section 12 and second table section 14 hold the plate firmly against the table surface. Thereafter, second table section 14 is manually moved toward the operator, i.e. away from first table section 12. Vacuum ports 22 in second table section 14 pull a lesser vacuum than ports 22 of first table section 12, permitting movement of section 14 away from first table section 12 without movement of the printing plate 24. The printing cylinder 26 disposed beneath the table is raised using the cylinder carriage drive means 34, until the upper surface of cylinder 26 is coplanar in tangential fashion with table section 12. Table section 14 is at its lower position (see FIG. 4). The free end of plate 24 is pressed onto cylinder 26 at a scribe reference line, and the cylinder 26 is rotated, for example by measured rotation achieved by drive means 30, while the vacuum ports 22 are inactivated to permit the plate to slip off table 10 onto cylinder 26.

Thereafter, if additional plates 24 are to be mounted on cylinder 26, the procedure is repeated. If a microprocessor is used, data previously fed into the microprocessor will provide automatic adjustment of the various drive means 18, 28, 30, and 34 to expedite mounting of subsequent printing plates.

Figure 6:
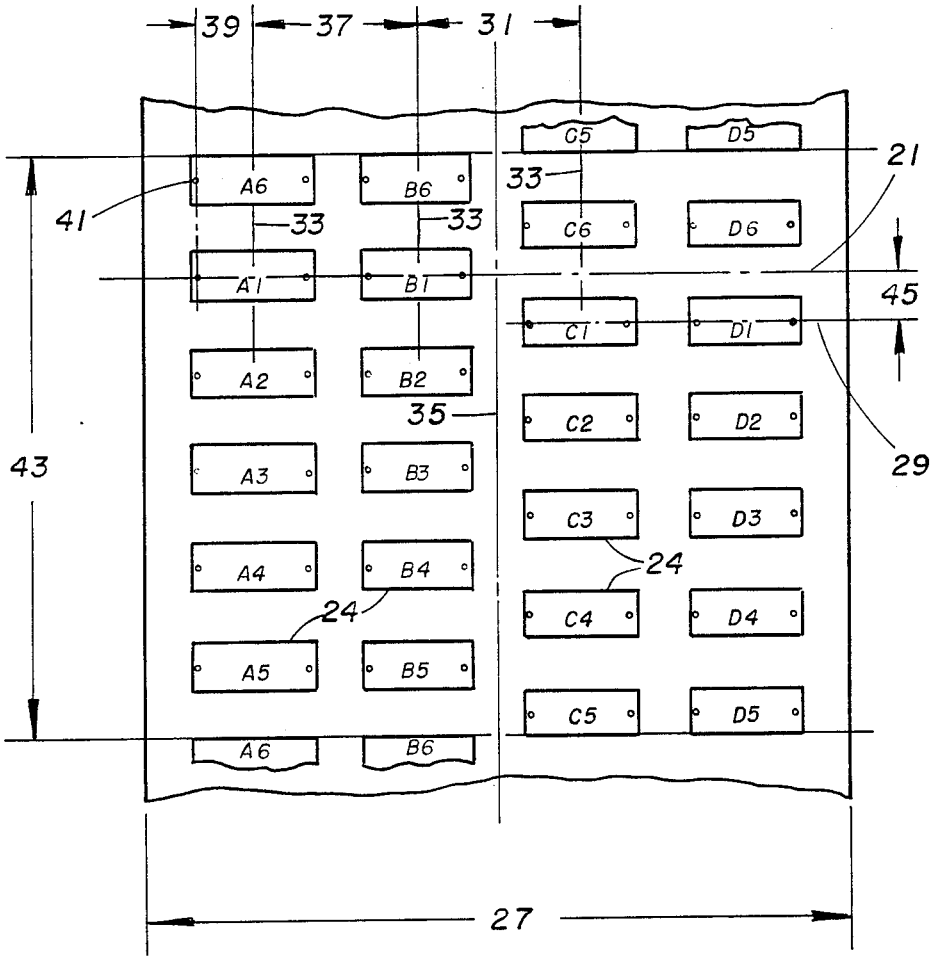
FIG. 6 is a paired offset plate layout in accordance with the present invention.
Figure 7:
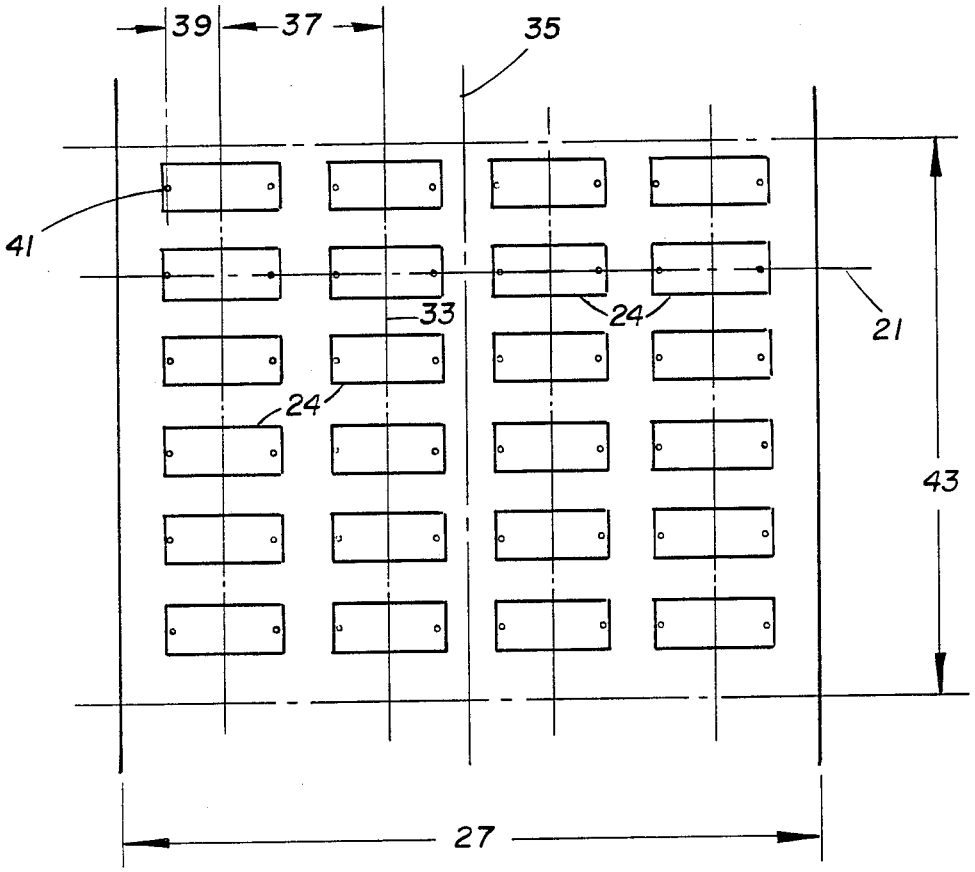
FIG. 7 is a schematic plate layout having no offset, in accordance with the present invention.

FIGS. 5, 6, and 7 show a layout of a printing cylinder with multiple printing plates to indicate the various ways in which more than one printing plate may be mounted on a printing cylinder.

The invention will be further explained by reference to the following preparation of the apparatus for a mounting procedure, and a sequence of steps in mounting multiple printing plates on a printing cylinder.

The microscope drive means 18 is set to within $\frac{1}{8}$ in. of ball screw end points to determine the travel limits of the microscope 16. A "home" set point for drive means 18 is established at the left edge of table 10. This is depicted as line 23 of FIG. 2.

Table drive means 28 are individually controlled to align the mating table surfaces of table sections 12 and 14 to within 0.001 in. vertical tolerance. These drives should be homed at the elevated position of the table and kept synchronized for proper operation.

The lower position 40 of table 10, and specifically section 14 thereof, is depicted in FIG. 4 and establishes a lower homed position.

A printing cylinder of known concentricity and flat surface is loaded into a cylinder carriage 32 and, with the table section 14 slid to the separated position, the cylinder is raised with cylinder carriage drive means 34 to a predetermined mounting level indicated at line 36 of FIG. 4. Each of cylinder carriage drive means 34 can be controlled and synchronized by laying a straight edge across each end of table 10. Thereafter, synchronization of carriage drive means 34 should be maintained. By determining and keying in the radius of the printing cylinder 26, a 0.000 reference can be established for carriage drive means 34 as the mount and premount levels indicated at lines 36 and 38 respectively of FIG. 4. Clearly, with variations in the radius of a given printing cylinder, the mount and premount levels 36 and 38 respectively will vary from one cylinder size to another.

After this procedure has been completed, the cylinder is lowered to a load level 40 (FIG. 4) and a stop point is established.

Referring to FIG. 1, vacuum port coverage is referenced to microscope 16. When the printing plate positions are calculated, only those vacuum ports that are completely covered by the printing plate should activate.

In an actual plate mounting sequence, the printing cylinder 26 is positioned at load level 40. The section 14 of table 10 is at its elevated position. A printing cylinder is manually loaded into cylinder carriage 32. The cylinder carriage 32 is then manually rolled horizontally under table 10, thereby inserting a cylinder shaft 42 of cylinder 26 into a rotational drive air chuck 44.

Rotational drive air chuck 44 may be engaged by operator push button.

In an application using a microprocessor, a mode is selected based on whether multiple plates or a single plate with multiple images will be used. Data is entered into the microprocessor, in for example English or metric units, after clearing the data memory of the system. The face width 27 of the printing cylinder, number of plates horizontally across the printing cylinder, center spacing 31 of printing plates from the cylinder vertical center line 35, horizontal plate to plate spacing 37 on either side of the cylinder center line 35, register point offset 39 from the center of the plate 33, cylinder repeat length 43 (circumference at the printing surface), the number of plates around the cylinder (vertical), the vertical offset 45 from column to column and the thickness of the sticky back adhesive layer which is prewrapped on the printing cylinder, are all entered into the microprocessor memory.

Referring now to FIGS. 5 and 6 these drawings show an offset plate layout in which the plates are offset or staggered vertically or with respect to the circumference of the printing cylinder. Offsetting of multiple printing plates on a printing cylinder is often necessary to achieve uniformity in print in the finished label. The extent of and manner of offset is primarily dictated by the particular design and colors to be printed.

Referring to FIGS. 5, 6, and 7, the types of data entered into the microprocessor are graphically illustrated. The printing cylinder 26 has a face width 27 spanning the width indicated by the arrows. In FIG. 5, six printing plates are placed across, and six printing plates circumferentially around the printing cylinder 26 to give a total of 36 printing plates mounted on a single printing cylinder 26. For the sake of illustration, each printing plate is given an alphanumeric designation, beginning with plate A1 in the first column, with labels of the same letter within each column mounted in a particular mounting sequence. The center spacing 31 of printing plates from the cylinder vertical center line 35 (see FIG. 6) is determined by the distance between the center lines 33 of adjacent plates in the central region of the cylinder.

Horizontal plate to plate spacing 37 on either side of the cylinder center line is likewise determined by the distance between adjacent plates 24 measured at plate center lines 33.

The register point offset 39 from the center of each plate 24 is derived from the distance between the center line 33 of each plate, and its respective register point 41.

Cylinder repeat length 43 is simply the circumference of the printing cylinder 26 at its printing surface, taking into account both the plate thickness and the presence of double sticky back tape, or other suitable adhesive prepared on the printing cylinder prior to the mounting procedure.

The vertical offset 45 is equivalent to the distance between the horizontal register scribe line 21 and the vertical offset line 29.

In FIG. 5, each column is offset the same amount with respect to the preceding column. In contrast, in FIG. 6, the layout reveals a paired offset in which adjacent columns A and B and adjacent columns C and D respectively exhibit no offset, but columns C and D are offset by a vertical offset 45 with respect to columns A and B.

FIG. 7 shows a plate layout with no vertical offset 45, and otherwise similar to the plate layouts described for FIGS. 5 and 6.

After the data has been entered as described above, the second section 14 of table 10 is manually moved towards the operator to a preset distance making a microswitch (not shown) to activate, causing the printing cylinder 26 to automatically rise to its mount position (see FIG. 4). The mount position of the printing cylinder 26 must be interlocked with the closed position of table 10.

Using a linear speed controlling joy stick with left-right controls, the microscope drive means 18 is activated to move the microscope 16 to sight the left edge of the printing cylinder face (FIG. 2).

Using the front-back portion of the same joy stick to control the direction and speed of cylinder rotation, cylinder rotation drive means 30 is activated to align the horizontal scribe line 27 (FIG. 5) under microscope 16. These horizontal and vertical positions are entered as home references. This entry in turn causes the printing cylinder 26 to automatically lower to premount position 38, and the table 10 to rise if it is in the lower position.

The table is then manually closed making a microswitch automatically cause the microscope 16 to move to the first or next plate mounting register point.

A printing plate 24 is then placed on Table 10. The left register point of the printing plate is aligned under microscope 16 and the right register point under a floating microscope spaced a given distance from first microscope 16. Selected vacuum ports 22 are activated to hold the plate to Table 10 by operator push button. A foot switch may also be used. The vacuum coverage is automatically calculated to choose any of 19 pair of vacuum ports 22, in order to activate only those ports completely covered by printing plate 24.

The table is manually opened to a preset distance causing the printing cylinder to raise to the mount position. The table is further opened to a full out position causing the second table section 14 of table 10 to lower while the operator smooths the front side of the plate down and around the printing cylinder 26.

The vacuum ports are then deactivated by operator pushbutton.

The cylinder is then automatically rotated forward by half of the plate vertical distance while at the same time the surface of the plate facing the cylinder is smoothed around the cylinder as it is rotated.

By depressing a "next/verify" pushbutton, the printing cylinder 26 is lowered to the premount position 38, and the second table section 14 raised to its up position. At the same time, printing cylinder 26 is rotated to the next vertical register point in the same column. In the event that a plate is to be mounted in a new column, the microscope will automatically move horizontally to a new position.

It should be noted that in practice, depending on the number of plates already placed around the cylinder, it is useful to compare the present position of the cylinder and the next register point to determine the direction of rotation of the printing cylinder for the shortest travel in order to return it to its vertical register point.

The steps described above, beginning with manually closing the table to activate the microswitch causing the microscope 16 to move to a first or next plate mounting register point, are repeated until column A (FIG. 5) is complete i.e. until all of the printing plates 24 to be mounted around the printing cylinder 26 at one vertical column thereof are so mounted.

When the last plate in a column has been placed, depression of the "next/verify" pushbutton causes microscope 16 to shift horizontally to the first plate of the next column, i.e., column B of FIG. 5.

The step repetition is then continued until all plates are mounted in all the columns.

By suitable microprocessing, the cylinder 26 automatically lowers, after the last plate has been mounted, to a cylinder load level 40. Air chuck 44 is automatically disengaged, and the cylinder carriage 32 bearing the printing cylinder 26 may then be moved manually from under the table, and the cylinder unloaded.

If another printing cylinder is to be mounted with printing plates in an identical pattern to the first printing cylinder, a repeat pushbutton is pressed for motion control and the previous steps are repeated, but excluding data entry.

If the next cylinder to be mounted has a different pattern, the data entry step, of course, must be included in this procedure.

It may be desirable to mount a single plate, for example, a single plate having multiple images, instead of multiple plates on a given cylinder. In this mode, a single wrap-around plate 24 contains multiple images imprinted on it as if they were individual plates (see FIG. 8).

In this embodiment, data is entered by clearing the data memory, and entering the face width 27 of the printing cylinder, the register point offset 55 of the single plate, the cylinder repeat length 43, the thickness of the sticky back layer, the number of images across, the center spacing of images 47 from the cylinder center line 35, the image-to-image spacing 49, the register point offset of images 51, the number of images around the cylinder, and the vertical offset 53 of images column-to-column. The sequential steps are taken as in the previous example up to and including the rotation of the cylinder forward to mount the single plate on the printing cylinder 26.

Figure 8:
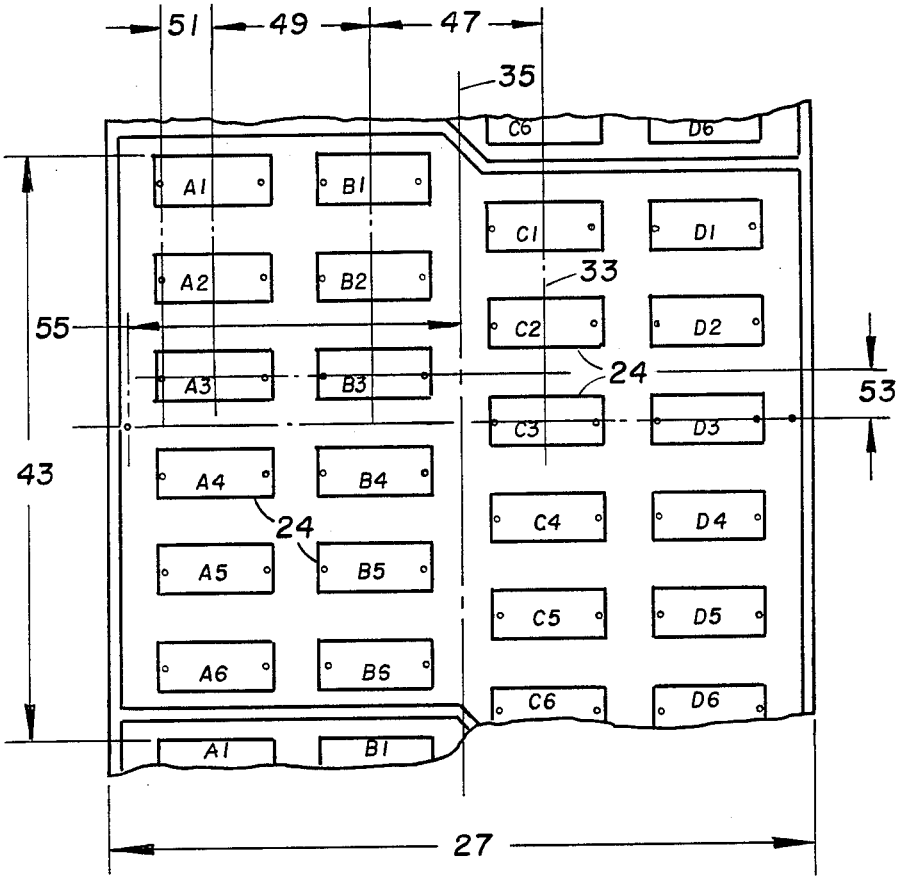
FIG. 8 is a schematic plate layout of a single plate with multiple images, in accordance with the present invention.

Thereafter, the joy stick is activated, and the microscope 16 is moved while rotating the cylinder to line up the microscope 16 with the register point on image A-1 (FIG. 8). Each depression of the "repeat/verifier" pushbutton causes the microscope and cylinder to automatically and successively line up image register points such that each can be viewed for artwork verification. When all images are verified, a signal causes the printing cylinder to lower to load level 40. The air chuck 44 is automatically disengaged.

The cylinder carriage 32 is then manually moved from under the table 10 and cylinder 26 is unloaded.

As in the previous example, if the next cylinder is the same pattern, a "repeat" pushbutton is pressed for motion control and the steps are repeated, excluding the data entry step. If the next cylinder required has a different pattern, the data entry step must be included as well.

Figure 9:
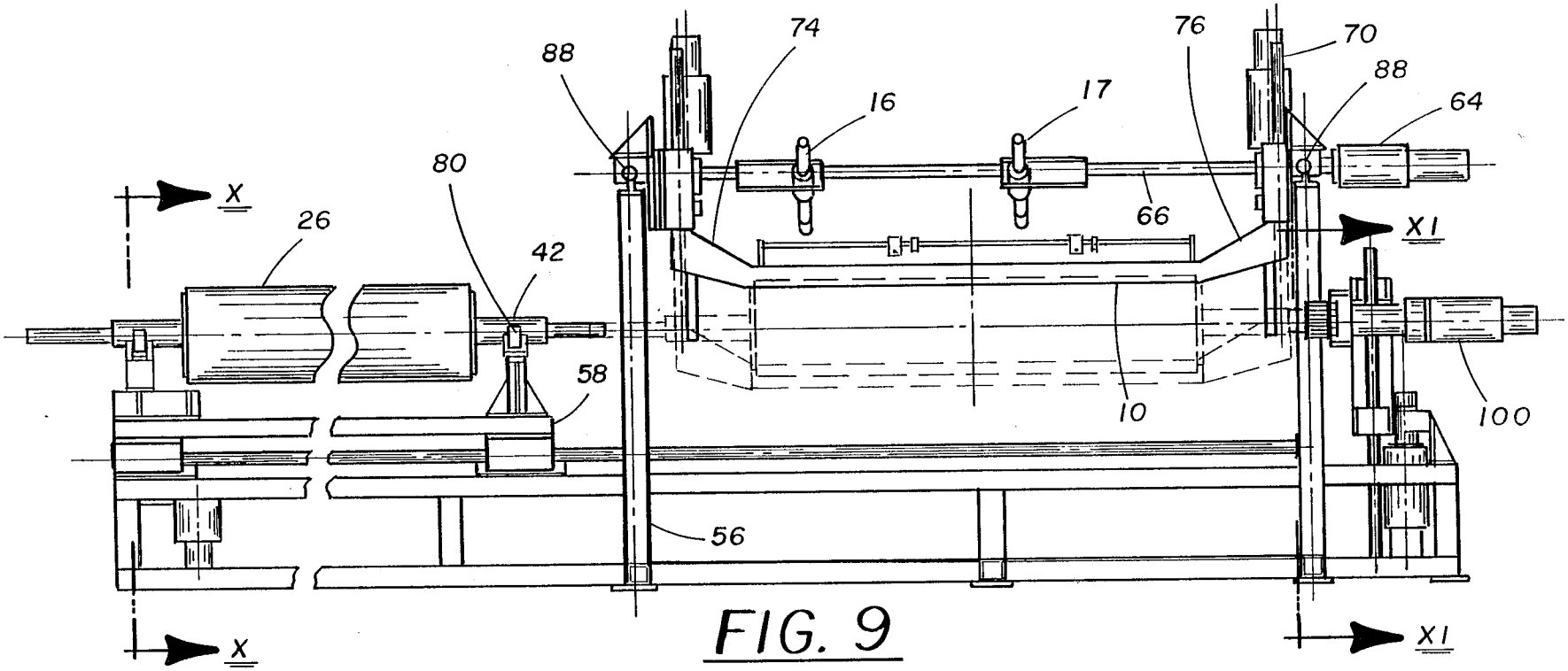
FIG. 9 is a front elevational view of a printing plate mounter in accordance with the present invention.
Figure 10:
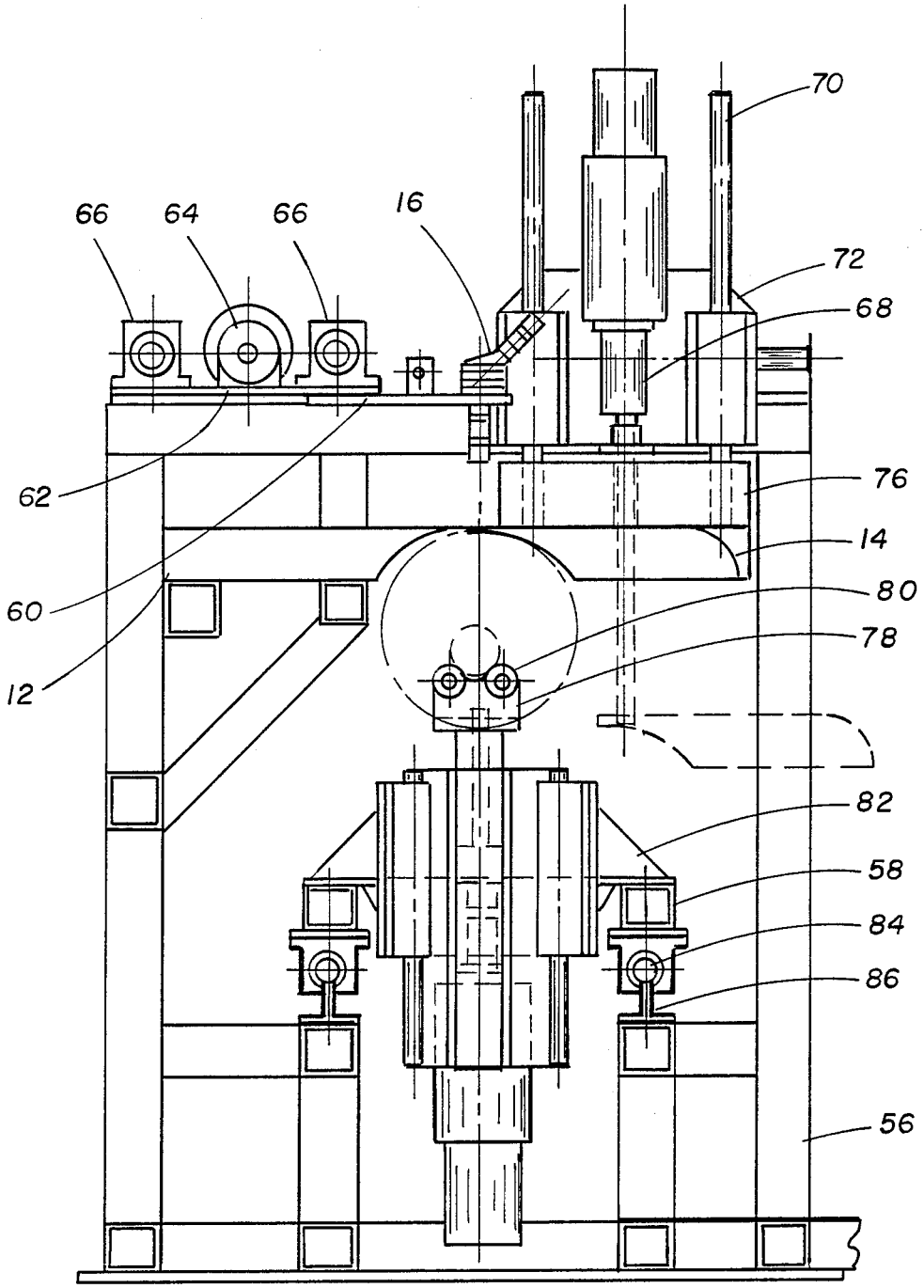
FIG. 10 is a side elevational view of FIG. 9 taken along line X—X of FIG. 9.
Figure 11:
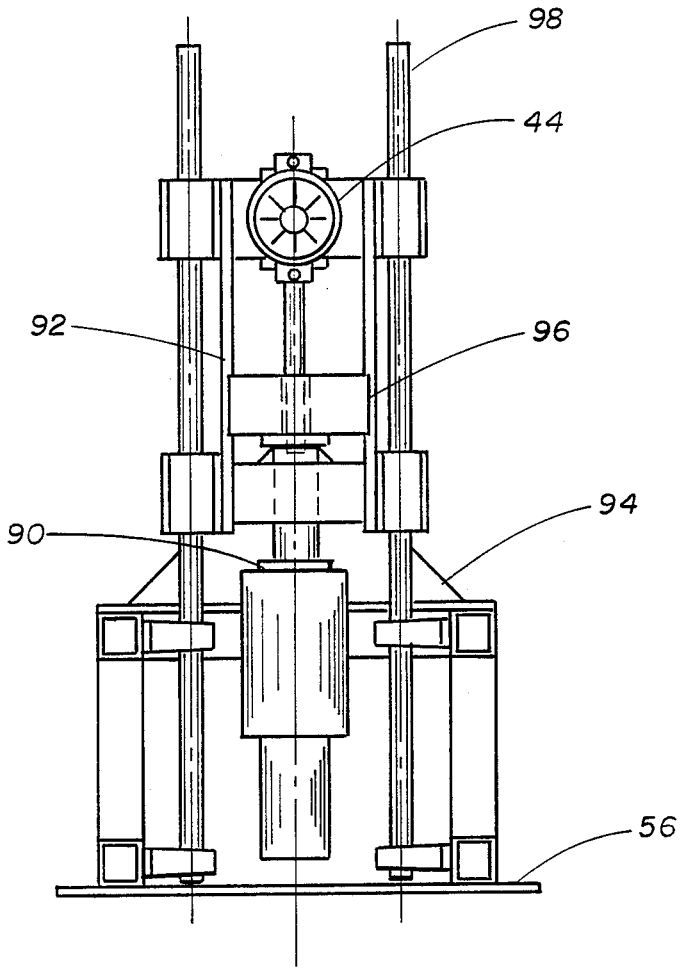
FIG. 11 is a side elevational view of a portion of the plate mounter of FIG. 9 taken along lines XI—XI of FIG. 9.

The invention may be further understood by reference to FIGS. 9, 10, and 11 showing a specific embodiment of the present invention. In FIG. 9, the printing plate mounter includes a main frame 56 and carriage frame 58. An overhead microscope 16 and a second floating microscope 17, positioned an adjustable fixed distance from microscope 16, are located above table 10. Scope support 20 includes a scope mount 60 and scope mounting plate 62 (see FIG. 10). The scope drive means 18 includes a motor 64 and guide shaft 66 for providing horizontal movement of microscope 16 and 17 in alignment with and above table 10.

Table drive means 28 allows for vertical movement of table 10 during the mounting process, and is provided with motor 68, guide shafts 70, and slide bracket 72. A first sliding table mount 74 and second sliding table mount 76 support table 10. In addition, counter balance air cylinders can be used to provide vertical support of table 10 during a fault condition.

The printing cylinder 26 is supported by a pair of bottom plates 78 located at either side of cylinder 26. Bottom plates 78 each house a pair of roll supports 80 which in turn cradle cylinder shafts 42 at either end of printing cylinder 26. Guide shafts 84 are encompassed by a shaft rail 86, permitting horizontal movement of the printing cylinder 26 under the table 10 for the mounting process.

Shaft rail 88 located at either side of and above table 10 and table mounts 74 and 76 permits the table sections 12 and 14 respectively to be separated during the mounting process.

Referring to FIG. 11, an air chuck 44 engages cylinder shaft 42 when the printing cylinder 26 is moved under table 10 prior to mounting. Motor 90, slide plates 92, mounting bracket 94 and lifting plate 96 permit vertical movement of the cylinder towards the cylinder load level 40, guided by shafts 98.

Cylinder rotation drive means 30 includes a motor 100 for rotating the cylinder during the actual mounting step.

When utilizing a microprocessor for plate mounting, a suitable commercially available unit is the International Cybernetics Model 3200 Microcomputer. Appropriate software to run the microcomputer and perform tasks such as data entry and operation of the various drive means is used. In the preferred embodiment, inputs to the microprocessor include an on and off push button for the activation and deactivation respectively of air chuck 44; a preset microswitch for table 10 at the out position; a full microswitch for the table 10 at both the out and in positions; push buttons to activate and deactivate the vacuum ports 22; a "next/verify" push button; a push button to repeat a given sequence; an analog joy stick for activation and control of microscope drive means 18 and cylinder rotation drive means 30; a data entry keyboard; and a switch for conversion between automatic and manual operation. The particular mode employed, for example a multiplate mode, or a single plate with multiple image mode, may be selected by selecting the particular software for use in the microprocessor.

Nineteen pairs of vacuum solenoids are controlled by pairs, and an air chuck solenoid for air chuck 44 is also utilized.

Although the present invention has been described in conjunction with preferred embodiments, it should be understood that modifications may be made without departing from the principles of this invention, as those skilled in the art will understand. Accordingly, such modifications may be practiced within the scope of the following claims.

What is claimed is:

1. An apparatus for mounting a flexible printing plate on a printing cylinder comprising;

(a) a table comprising two separable sections forming a planar surface;

(b) means for aligning the position of the printing plate on the table in order to accurately mount the printing plate on the cylinder;

(c) means for separating said sections;

(d) means for moving said printing cylinder between said sections for receiving said plate; and (e) means for adhering the printing plate to the printing cylinder.

2. An apparatus for mounting a flexible printing plate on a printing cylinder comprising:

(a) a table comprising two horizontally separable sections forming a horizontal planar surface;

(b) means for aligning the position of the printing plate on the table in order to accurately mount the printing plate on the cylinder at predetermined coordinates;

(c) means for separating said sectios;

(d) means for moving said printing cylinder between said sections for receiving said plate;

(e) means for rotating the printing cylinder during mounting of the printing plate on the cylinder; and (f) means for adhering the printing plate to the printing cylinder.

3. An apparatus according to claim 1 further comprising a housing for supporting said table.

4. An apparatus according to claim 1 further comprising means for horizontally separating said table sections to expose the upper surface of the printing cylinder.

5. An apparatus according to claim 1 further comprising means for moving said table in a vertical direction.

6. An apparatus according to claim 1 further comprising means for supporting the printing cylinder.

7. An apparatus according to claim 1 further comprising means for moving the printing cylinder in a vertical direction.

8. An apparatus according to claim 1 wherein the aligning means comprises a microscope disposed above and in alignment with the printing cylinder and table, and register marks on the printing plate.

9. An apparatus according to claim 1 further comprising means for horizontally moving the aligning means in alignment with and above the printing cylinder.

10. An apparatus according to claim 1 further comprising means for holding the printing plate to the table.

11. An apparatus according to claim 10 wherein the holding means comprises vacuum ports distributed along and substantially flush with the table.

12. A method of mounting a flexible printing plate on a printing cylinder comprising:

(a) placing a printing plate on a table having two separable sections forming a planar surface;

(b) aligning the position of the plate to match predetermined coordinates;

(c) separating the sections of the table;

(d) placing the printing cylinder between the separated sections; and (e) transferring the plate from the table to the cylinder.

13. The method of claim 12 further comprising temporarily holding the plate to the table, after adjusting the location of the plate, to prevent substantial lateral movement of the plate prior to mounting.

14. The method of claim 13 wherein a pair of vacuum ports in the table, underneath the placed and aligned printing plate, are activated to hold the plate to the section of the table bearing the vacuum ports.

15. The method of claim 12 further comprising rotating the cylinder during the mounting step.

16. The method of claim 12 further comprising wrapping adhering means onto the cylinder prior to mounting.

17. The method of claim 12 further comprising positioning the printing cylinder below the table prior to mounting, and raising the cylinder, after separating the table sections, until the upper surface of the cylinder is coplanar with the table sections.

18. The method of claim 12 wherein the plate is transferred to the cylinder by manually pressing one edge of the plate onto the cylinder at a predetermined reference line on the cylinder, and thereafter rotating the cylinder to complete the transfer of the plate to the cylinder.

19. The method of claim 18 wherein one section of the table facing an operator is lowered to facilitate transfer of the plate to the cylinder.

* * * * *